US008746695B2

(12) United States Patent
Jang

(10) Patent No.: US 8,746,695 B2
(45) Date of Patent: Jun. 10, 2014

(54) PAPER MONEY PROCESSING APPARATUS HAVING STRUCTURE FOR EASILY PREVENTING PAPER MONEY JAMS

(75) Inventor: Sang Hwan Jang, Seoul (KR)

(73) Assignee: Kisan Electronics Co., Ltd., Seoul (KR)

( * ) Notice: Subject to any disclaimer, the term of this patent is extended or adjusted under 35 U.S.C. 154(b) by 0 days.

(21) Appl. No.: 13/811,383

(22) PCT Filed: Apr. 26, 2011

(86) PCT No.: PCT/KR2011/003021

§ 371 (c)(1),
(2), (4) Date: Jan. 21, 2013

(87) PCT Pub. No.: WO2012/015148

PCT Pub. Date: Feb. 2, 2012

(65) Prior Publication Data

US 2013/0113159 A1 May 9, 2013

(51) Int. Cl.
*B65H 5/00* (2006.01)

(52) U.S. Cl.
USPC ..... 271/264; 209/534

(58) Field of Classification Search
USPC ..... 209/534; 194/200, 206, 207; 399/107, 399/110, 124, 125, 21; 271/184, 287–289, 271/264, 279, 280
See application file for complete search history.

(56) References Cited

U.S. PATENT DOCUMENTS

| | | | | |
|---|---|---|---|---|
| 5,245,357 | A * | 9/1993 | Maruyama et al. | 346/134 |
| 5,806,650 | A | 9/1998 | Mennie et al. | |
| 6,019,207 | A * | 2/2000 | Cole | 194/206 |
| 6,278,795 | B1 * | 8/2001 | Anderson et al. | 382/135 |
| 7,526,214 | B2 * | 4/2009 | Asaba | 399/21 |
| 7,844,190 | B2 * | 11/2010 | Asaba | 399/21 |
| 8,029,129 | B2 * | 10/2011 | Hashimoto et al. | 347/108 |
| 2003/0038062 | A1 | 2/2003 | Werner et al. | |
| 2006/0018672 | A1 * | 1/2006 | Asaba | 399/21 |
| 2007/0215594 | A1 * | 9/2007 | Hashimoto et al. | 219/400 |

FOREIGN PATENT DOCUMENTS

| | | | |
|---|---|---|---|
| EP | 1 864 926 | B1 | 12/2007 |
| JP | 8-151166 | A | 6/1996 |
| JP | 2005-330067 | A | 12/2005 |
| JP | 2009-15095 | A | 1/2009 |
| JP | 2009-80749 | A | 4/2009 |

OTHER PUBLICATIONS

Tsunemasa Suzuki, Korehisa Maruta and Hideki Maruyama; "Bill Counter"; Espacenet, Bibliographic data; Japanese Publication No. JP2009080749 (A); Publication Date: Apr. 16, 2009; Worldwide Database, http://worldwide.espacenet.com/publicationDetails/biblio?DB=EPODOC&II=0&ND=3&a . . .

(Continued)

*Primary Examiner* — Thomas Morrison
(74) *Attorney, Agent, or Firm* — Murabito Hao & Barnes LLP; Andrew D. Fortney

(57) ABSTRACT

The present invention relates to a paper money processing apparatus. In the paper money processing apparatus for sorting and counting paper money, the apparatus is divided into three parts in order for sections of a transfer path to open the whole transfer path. When jammed paper money is removed, portions separated from a fixed main body are linked with each other through links to remove the jammed paper money through only one operation.

15 Claims, 4 Drawing Sheets

(56) References Cited

OTHER PUBLICATIONS

Hiroshi Shin and Yasuhiro Miyake; "Image Forming Apparatus"; Espacenet, Bibliographic data; Japanese Publication No. JP2009015095 (A); Publication Date: Jan. 22, 2009; Worldwide Database, http://worldwide.espacenet.com/publicationDetails/biblio?DB=EPODOC&II=#&ND=3&a . . .

Hiroshi Ito; "Image Forming Device"; Espacenet, Bibliographic data; Japanese Publication No. JP2005330067 (A); Publication Date: Dec. 2, 2005; Worldwide Database, http://worldwide.espacenet.com/publicationDetails/biblio?DB=EPODOC&II=1&ND=3&a . . .

Tatsuya Shiratori; "Sheet Carrying Device and Image Forming Device"; Espacenet, Bibliographic data; Japanese Publication No. JP8151166 (A); Publication Date: Jun. 11, 1996; Worldwide Database, http://worldwide.espacenet.com/publicationDetails/biblio?DB=EPODOC&II=0&ND=3&a . . .

International Search Report with English Translation; International Application No. PCT/KR2011/003021; Dated Oct. 31, 2011; 4 pages total; International Searching Authority/Korean Intellectual Property Office, Republic of Korea.

KIPO Notice of Submission of Opinion with English Translation; Korean Patent Application No. 10-2010-0072252; Dated Oct. 24, 2011; 6 pages total; Korean Intellectual Property Office, Republic of Korea.

* cited by examiner

PAPER MONEY PROCESSING APPARATUS HAVING STRUCTURE FOR EASILY PREVENTING PAPER MONEY JAMS

TECHNICAL FIELD

The present invention relates to a paper money processing apparatus, and more particularly, to the paper money processing apparatus having the structure for quickly and efficiently removing a jam of a paper money by opening the whole transfer path of the paper money processing apparatus by one time opening operation when the paper money has jammed on a transfer path while the apparatus is processing the paper monies.

BACKGROUND OF INVENTION

FIG. 1 shows a perspective view of a conventional exemplary paper money processing apparatus 10 having one pocket structure, and FIG. 2 shows a side view representing the paper money processing apparatus 10 in the opened status to remove a paper money jammed on a transfer path 20 in the paper money processing apparatus 10 of the one pocket type.

FIG. 3 shows a side view of a paper money processing apparatus 30 described in U.S. Pat. No. 6,772,886 as a prior art of the present invention, and FIG. 4 shows a side view representing the apparatus 30 in the opened status to remove a paper money jammed on a transfer path 40.

In FIGS. 2 to 8, bold broken lines represent paper money transfer paths from an inputting moment of the paper money to an outputting moment thereof, and for describing the present invention numerals 20*a*, 20*b*, 40*a*, 40*b*, 40*c*, 80*a*, 80*b* and 80*c* represent each of the sections of the transfer paths 20, 40, 80 in paper money processing apparatuses 10, 30, 50.

In the one pocket-type paper money processing apparatus 10 as shown in FIG. 1, since the apparatus 10 has a short paper money transfer path 20 and a simple structure as in FIG. 2, when a paper money under processing has been jammed on a transfer path, the transfer path section A (20*a*) can be exposed and easily approached by respectively opening a upper part 11 and a backward part 13. Additionally, since a lower part 12 of the apparatus 10 has short height, when the paper money has been jammed in a transfer path section B (20*b*), the jammed paper money can be removed by hands of a user.

However, a paper money processing apparatus 30 having several pockets as shown in FIG. 3 similar to that of the present invention is configured to have a longer transfer path 40 with U-shape for placing the several pockets, unlike those of FIGS. 1 and 2. The longer and complicated transfer path 40 as in FIG. 3 makes a probability of the paper money jam higher on the transfer path 40. If the paper money jam occurs on the transfer path 40, the jammed paper money can be removed when the transfer path is opened at most widely and the position and the status of the jammed paper money are found.

To overcome the problems as described above, as shown in FIG. 4, there has been suggested a structure having outer parts and a central stationary part therebetween so that the outer parts can be decoupled and opened forward and backward from the central stationary part, if the jam occurs.

However, since general paper money processing apparatuses have transfer paths vertically formed due to space restriction of the apparatus, in case of opening the apparatus 30 to remove the jam, the paper money jammed in a transfer path section A (40*a*) or a transfer path section C (40*c*) falls on a baseplate and then is jammed in a transfer path section B (40*b*). In case of jamming in the transfer path section B (40*b*), the paper money jam is not easy to be removed, because the structure of the central stationary part 31 fixed onto the baseplate makes access or approach to the transfer path section B (40*b*) difficult. Additionally, although the transfer path section B (40*b*) has a drop door movable up and down, the height of the drop door is too low and narrow to remove the jam by hands and to find the jammed paper money with the eyes.

Further, in case of jamming in the transfer path section C (40*c*), in view of a user, the user can remove the jam by pulling the front outer part 33 forward. However, in case of jamming in the transfer path section A (40*a*), in view of the user the user cannot easily remove the jam because the user has to pull the back outer part 32 backward from the front and to wedge his hand into the bottom portion of the transfer path section A (40*a*) to remove the jam. That is, the user needs to have a wider range of action or take bigger action to remove the jam in the transfer path section A (40*a*) spaced far away from the front of the user, and will not easily find the jammed paper money.

In addition, the user usually places the paper money processing apparatus close against the wall or the partition on the desk. In this case, when the jam occurs in the backward transfer path section A (40*a*), the user has to move the apparatus to the front-side of him, and therefore, since the apparatus often has to be moved by the user, the user feels discomfort to use it and the apparatus needs to occupy the broader space to be placed. Therefore, there are some problems that degrade the convenience and the efficiency of the paper money processing apparatus.

DETAILED DESCRIPTIONS OF INVENTION

Objections to be Solved

The purpose of the present invention is to provide a paper money processing apparatus to quickly and efficiently remove a jam of a paper money wherever the jam occurs on a transfer path by opening the whole transfer path of the paper money processing apparatus by one time opening operation when the paper money has jammed on the transfer path.

Means for Solving Objections

In order to achieve the purpose of the present invention, the paper money processing apparatus has a transfer path formed of three transfer path sections that can be entirely opened. Further, the paper money processing apparatus comprises a stationary main body part and other two parts that can be respectively decoupled from the stationary main body part, the stationary main body part and the other two parts being each other coupled by a link to interlock them, and decoupling of one part allowing to open the other parts by the interlocking in order to open the whole transfer path by one time opening operation. This makes removing of the jam quick and effective.

Effects of Invention

When a paper money jam occurs the whole transfer path is opened. Therefore, a user can find a position of the jam easily and remove the jammed paper money quickly and efficiently.

Further, the user can open the whole transfer path by one time opening operation in case of opening the transfer path to remove the jam. Therefore, the user feels convenient and can use the space efficiently because both the front outer part 33 and the back-side outer part 32 of the conventional paper money processing apparatus 30 are opened forward toward the user.

Additionally, in case of jamming in a back-side transfer path section A (40*a*), the paper money processing apparatus in the prior art requires the wide space enough to pull the back outer part 33 backward to open the back-side transfer path section A (40*a*). Thus, there has been inconvenience to the user in that the paper money processing apparatus has to be installed with enough space or gap apart from the wall (or partition) or to be moved forward to be apart enough from the wall. The present invention provides convenience and efficiency when using the apparatus.

DESCRIPTIONS OF PREFERRED EMBODIMENTS OF THE INVENTION

The preferred embodiments of the present invention will be explained in detail in the following with reference to FIGS. 5 to 8.

Figure 5:
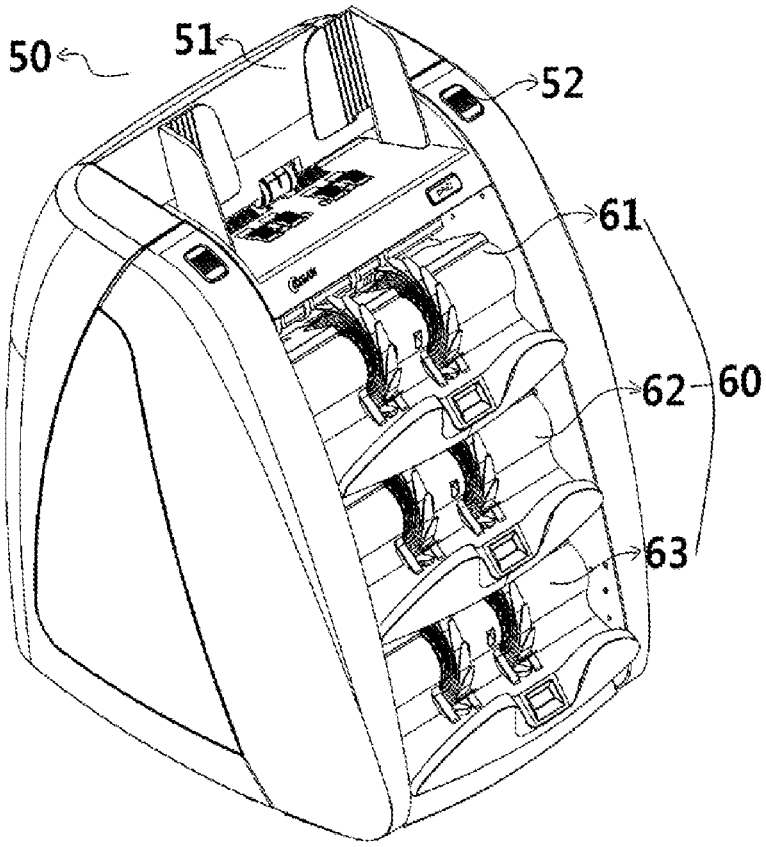
FIG. 5 shows an exterior view representing a paper money processing apparatus according to one embodiment of the present invention.

FIG. 5 shows an exterior view representing a paper money processing apparatus 50 according to one embodiment of the present invention, the apparatus comprising an input unit 51, three pockets 61, 62, 63 and an open button 52.

Figure 6:
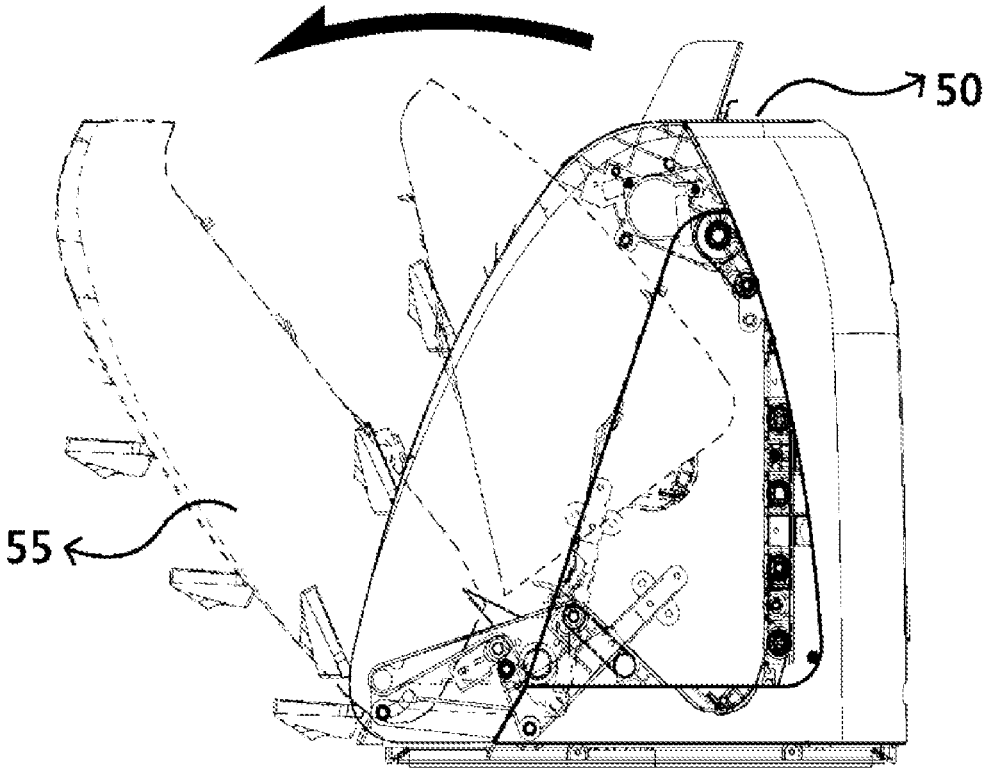
FIG. 6 shows a side view continuously representing the motion opening a paper money transfer path of the paper money processing apparatus according to the one embodiment of the present invention.

FIG. 6 shows a side view continuously representing the motion opening a transfer path of the paper money processing apparatus 50 according to the one embodiment of the present invention, illustrating the status that a front outer part 55 and a central part 54 being continuously opened interlocking each other like a fan-shape when the open button 52 is pushed and then the front outer part 55 is pulled forward.

Figure 7:
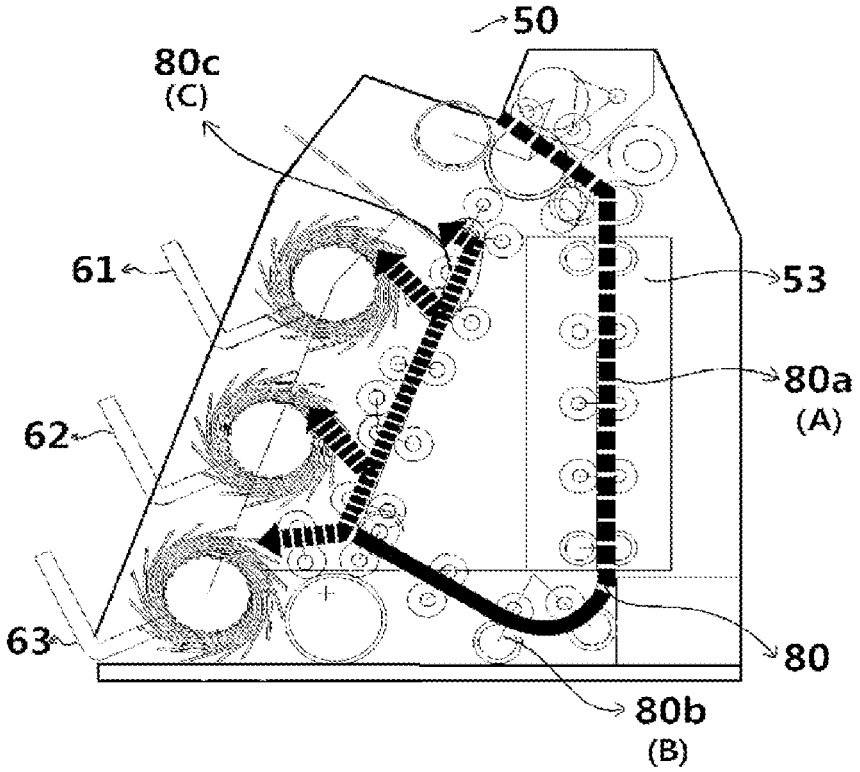
FIG. 7 shows a side view representing the paper money processing apparatus according to the one embodiment of the present invention.

FIG. 7 shows a side view representing the paper money processing apparatus 50 according to the one embodiment of the present invention, the apparatus including a U-shape transfer path and three pockets 61, 62, 63 as in the conventional paper money processing apparatus 30. If the transfer path has a simple structure of a '⊓'-shape or a '—'-shape, the problems to be solved by the present invention will be overcome. However, if the transfer path is formed longer, the volume of the paper money processing apparatus will be larger as well as its useless space. Therefore, it is desirable that the paper money processing apparatus of the three pocket type have the U-shape transfer path as mentioned above.

The paper money is jammed in any one of transfer path sections A (80*a*), B (80*b*) and C (80*c*) during its transfer in the paper money processing apparatus 50. To completely remove the jammed paper money anywhere in transfer path sections, the transfer path section A (80*a*), B (80*b*) or C (80*c*) has to be entirely opened, and to do so the constitution of the paper money processing apparatus has to be divided by three parts 53, 54, 55 corresponding to the transfer path sections as shown in FIG. 8.

Figure 8:
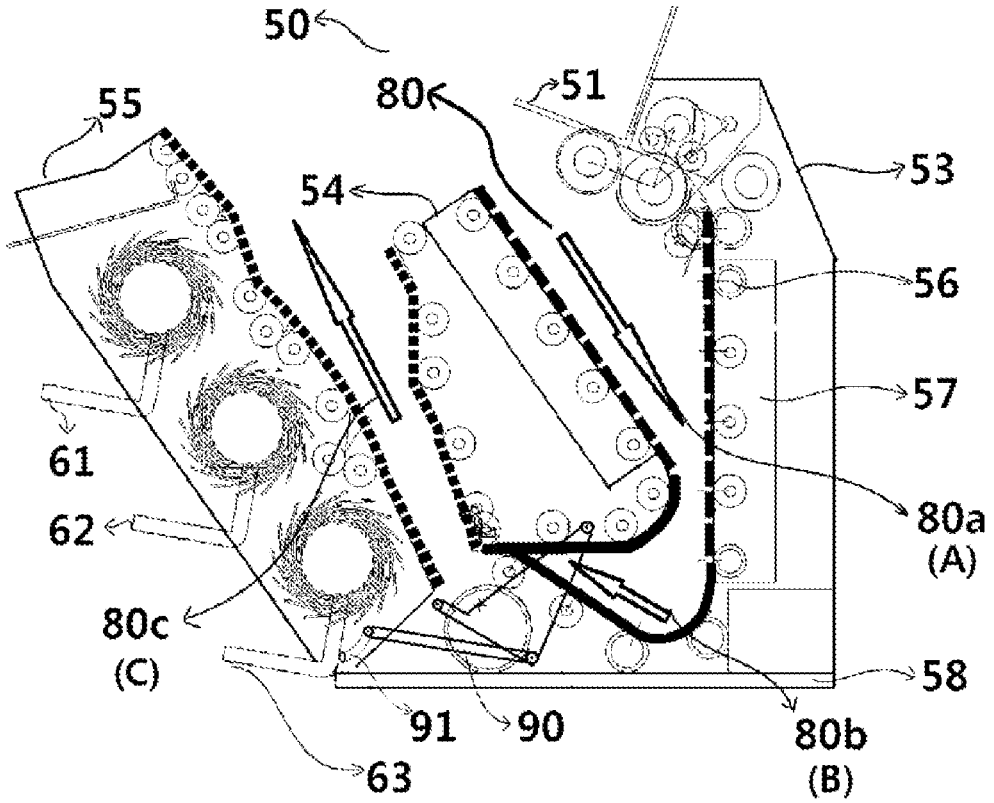
FIG. 8 shows a side view representing the status entirely opened the paper money transfer path in the paper money processing apparatus according to the one embodiment of the present invention.

To be divided and opened as shown in FIG. 8, the paper money processing apparatus 50 has a structure of placing a stationary main body part 53 in the back-side of the apparatus, a central part 54 in the middle of the apparatus and a front outer part 55 in the front-side of the apparatus. The conventional paper money processing apparatus has had the structure of placing the stationary main body part in the middle of the apparatus (See FIG. 4). The front outer part 55 and the central part 54 of the paper money processing apparatus 50 can be decoupled (or divided) from the stationary main body part 53 as shown in FIG. 8.

Figure 1:
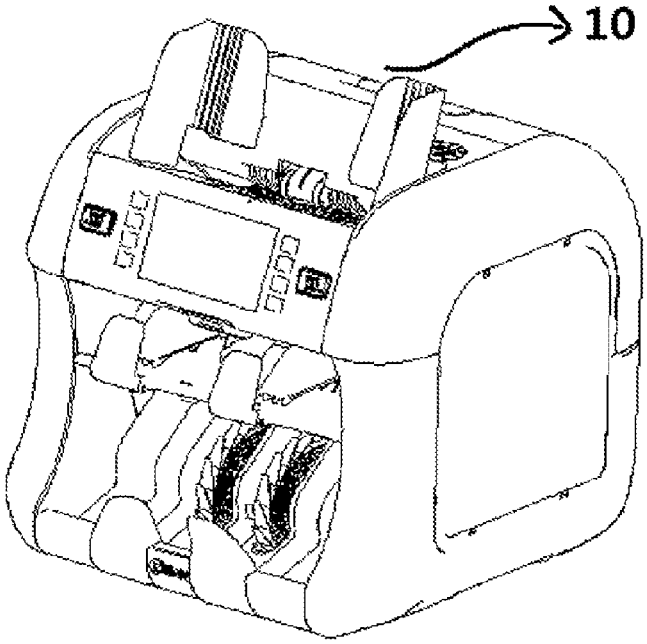
FIG. 1 shows a perspective view of a conventional exemplary paper money processing apparatus having one pocket structure.
Figure 2:
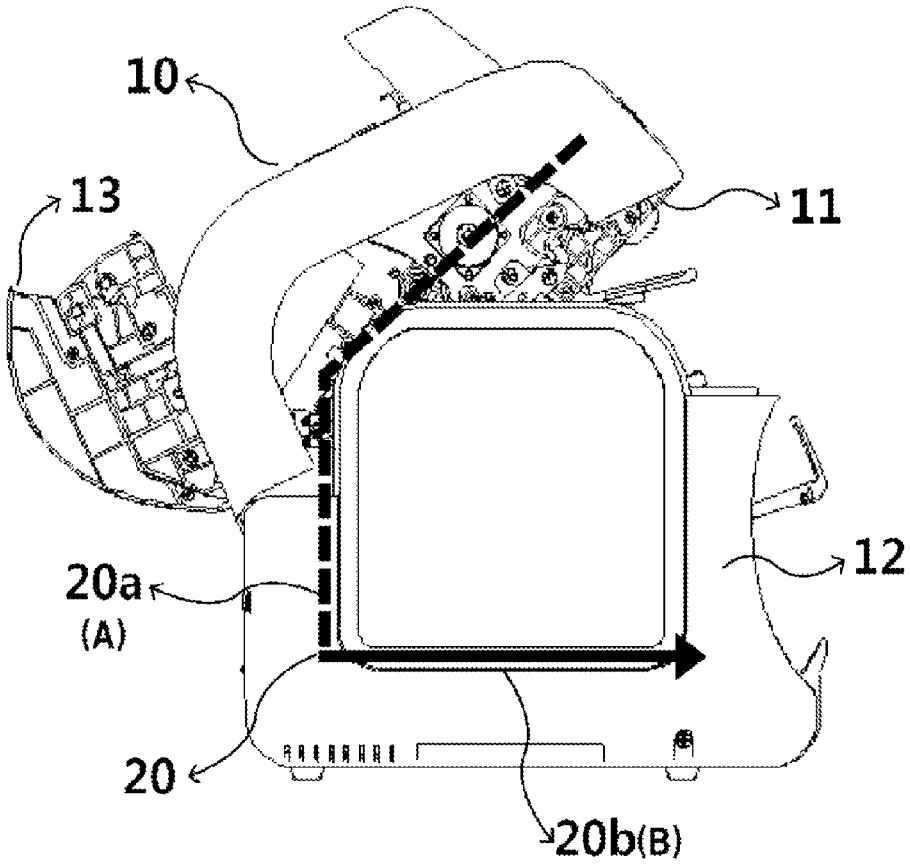
FIG. 2 shows a side view representing the status opened a paper money transfer path in the conventional paper money processing apparatus of the one pocket type.
Figure 3:
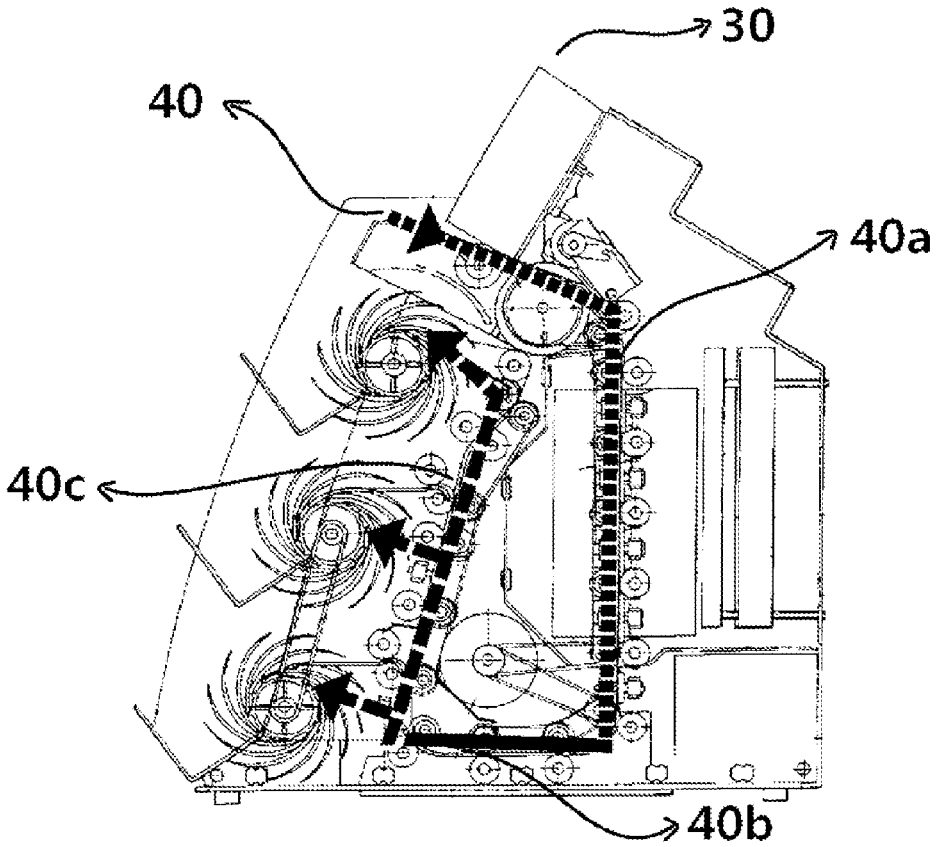
FIG. 3 shows a side view of a conventional paper money processing apparatus having three pockets.
Figure 4:
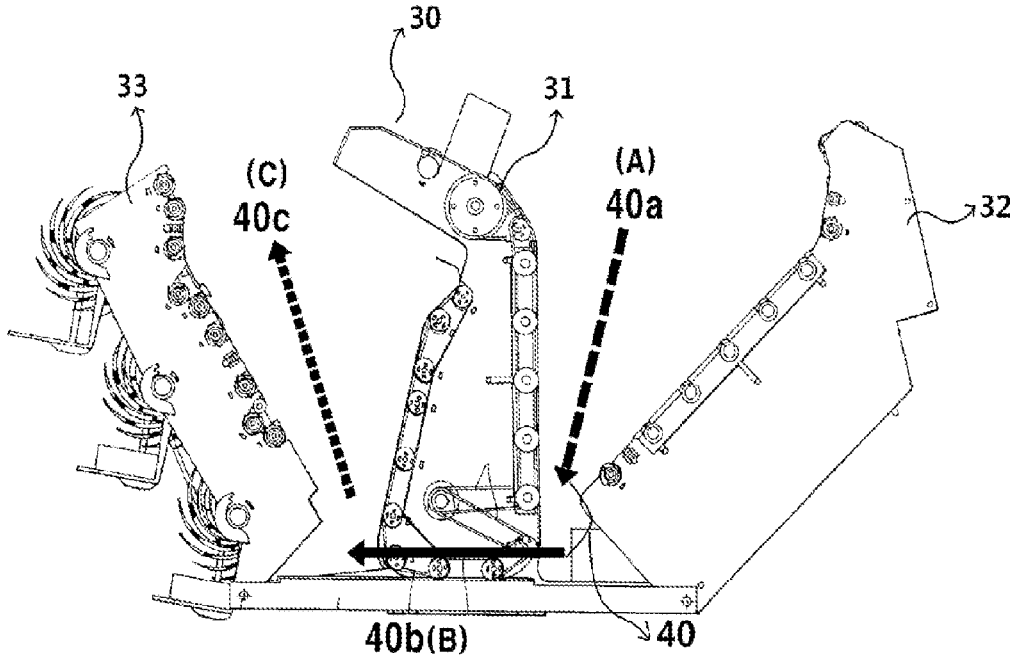
FIG. 4 shows a side view representing the status opened a paper money transfer path in the conventional paper money processing apparatus having the three pockets.

If an identifying unit 57 is placed in the central part 54 as in the conventional apparatus of FIG. 4 without changing arrangement location of the identifying unit 57, identifying capability of the identifying unit 57 may be degraded when the front outer part 55 and the central part 54 are divided from the back-side outer part 55. Therefore, in the present invention, the part including the identifying unit 57 is configured to be placed in the back-side of the apparatus as the main body of the paper money processing apparatus 50, and the other parts 54, 55 are configured to be easily decoupled (or divided) from the stationary main body part 53. Additionally, the front outer part 55 is configured to be fixed on a baseplate 58 by a stanchion 91 for preventing the front outer part from being tilted over a desired angle range.

The central part 54 is configured to be coupled with the front outer part 55 by a link 90, and therefore, continuously opened forward by interlocking together with the front outer part 55 when the front outer part 55 is opened. When the central part 54 is opened forward, the transfer path section B (80*b*) is also opened because the bottom surface of the central part 54 and the baseplate 58 are opened. Therefore, the whole transfer path is opened to easily remove the jammed paper money. The link 90 is installed at least one or more on each of right and left side portions inside the paper money processing apparatus 50 to connect or couple the front outer part 55 and the central part 54. Additionally, the link 90 may be further provided with a gas spring to easily open and close the parts of the apparatus just by applying little force.

Since the front outer part 55 and the central part 54 is coupled by the link 90 to be movable interlocking each other, when the front outer part 55 is pulled forward the central part 54 is also pulled and opened together, and therefore, the whole transfer path 80 can be exposed and opened by one time opening operation. In addition, various constructions and methods such as a slide and a chain can be employed or substituted if they can perform the functions that the front outer part 55 and the central part 54 is coupled each other and the front outer part 55 interlocks with the central part 54 when the front outer part 55 is pulled forward.

When the front outer part 55 and the central part 54 are opened interlocking each other, the transfer path and the space between the front outer part 55 and the central part 54 are configured to be able to open or close the central part 54 at an angle of 110 to 120 degrees from the surface of the baseplate 58 and to make the opening or closing angle of the front outer part 55 more than that of the central part 54. The stanchion 91 is configured to stop the said two parts 54, 55 from moving (opening) more than the said angle. The parts 54, 55 become fixed by the stanchion 91 when the parts 54, 55 are moved (opened) up to the said angle.

Therefore, the jammed paper money can be easily and quickly removed by once pulling the front outer part 55 no matter where the paper money is jammed in any section among the transfer paths 80*a*, 80*b*, 80*c* while the paper money is transferring for counting after inserting the paper money into the input unit 51.

As another embodiment according to the present invention, a paper money processing apparatus 50 comprises a stationary main body part 53, a central part 54 and a front outer part 55. The central part 54 is coupled to the front outer part 55 by a fastener like a chain type or a slide type. In this case the central part 54 is first opened together with the front outer part 55 at the moment the front outer part 55 is opened, and next, only the central part 54 can be separated from the front outer part 55 to be opened. Of course, on the contrary to this, at the moment the central part 54 is opened from the stationary main body part 53 the front outer part 55 is first opened together with the central part 54, and next, only the front outer part 55 can be separated from the central part 54 to be opened.

In the paper money processing apparatus, since the paper money is transferred with a high speed, transfer rollers 56 on the paper money transfer path that are formed of a plurality of pairs have to be closely contacted being opposite each other when the transfer path is opened and closed to remove the jammed paper money. This structure of the transfer path may make transfer path section separation of the paper money processing apparatus difficult. However, the embodiment of the present invention allows the user to open the whole transfer path just by one time opening action so that the jam can be quickly and efficiently removed.

To accomplish the purpose of the present invention, a paper money processing apparatus 50 comprises a stationary main body part 53 having a identifying unit 57, a central part 54 cable of exposing a baseplate 58, a front outer part 55 having an open button 52, a link 90 of coupling the central part and the front outer part, and a stanchion 91 coupled to the link 90 for preventing the front outer part 55 from being tilted over a desired angle range when the apparatus is open. Further, a paper money processing apparatus 50 comprises a stationary main body part 53, a central part 54 and a front outer part 55, wherein the central part 54 and the front outer part 55 are coupled each other by a link 90 on an axis of the link to interlock them. Therefore, when the front outer part 55 is opened, the central part 54 interlocked with the front outer part 55 is together opened by one time opening operation to open all transfer path sections 80*a*, 80*b*, 80*c* of a transfer path 80. It allows that the jammed paper money can be easily and quickly removed.

What is claimed is:

1. A paper money processing apparatus comprising:

a stationary main body in a back-side of the apparatus;

a central part in a middle of the apparatus;

a front outer part in a front-side of the apparatus, the front outer part comprising a plurality of pockets;

a link to couple the central part and the front outer part;

a stanchion coupled to the link for preventing the front outer part from tilting beyond a certain angle or angle range when the front outer part is open; and a paper money transfer path for transferring paper money from an input to the plurality of pockets, the paper money transfer path comprising a first transfer path section between the stationary main body and the central part, a second transfer path section under the central part, and a third transfer path section between the central part and the front outer part, wherein the central part and the front outer part are interlocked to each other, and opening the front outer part also opens the central part and the first, second and third transfer path sections of the paper money transfer path.

2. The apparatus of claim 1, wherein the central part is separate from the front outer part, and the front outer part is separate from the stationary main body part.

3. The apparatus according to claim 2, wherein the central part is separate from the stationary main body part, and the front outer part is separate from the central part.

4. The apparatus according to claim 1, wherein the stationary main body part includes a paper money identifying unit.

5. The apparatus according to claim 1, further comprising an open button for opening the front outer part.

6. The apparatus according to claim 1, wherein the front outer part comprises three pockets, and the second transfer path section has a U-shaped transfer path.

7. The apparatus according to claim 1, wherein opening the first, second and third transfer path sections of the paper money transfer path allows removal of paper money jammed in any one of the transfer path sections.

8. The apparatus according to claim 1, wherein the front outer part is fixed on a base plate by the stanchion.

9. The apparatus according to claim 1, wherein the link is on at least one of a right side portion and a left side portion inside the apparatus.

10. The apparatus according to claim 1, further comprising a slide that couples the front outer part and the central part.

11. The apparatus according to claim 1, further comprising a fastener coupling the front outer part and the central part.

12. The apparatus according to claim 1, further comprising a baseplate having a surface, the front outer part being fixed to the baseplate, and the baseplate being exposed when the central part is open.

13. The apparatus according to claim 12, wherein opening the front outer part and the central part configures the paper money transfer path and the space between the front outer part and the central part to open or close the central part at an angle of 110 to 120 degrees from the surface of the baseplate.

14. The apparatus according to claim 12, wherein the front outer part is fixed to the baseplate by the stanchion such that the front outer part is prevented from tilting beyond a certain angle or angle range when the front outer part is open.

15. The apparatus according to claim 1, further comprising a plurality of roller pairs, a first roller of each of said plurality of roller pairs being on an opposite side of the paper money transfer path from a second roller of each of said plurality of roller pairs.

* * * * *